US005887333A

United States Patent [19]

Clark

[11] Patent Number: 5,887,333

[45] Date of Patent: Mar. 30, 1999

[54] INSULATION DISPLACEMENT CONTACT WIRE INSERTION TOOL

[75] Inventor: William C. Clark, Lee's Summit, Mo.

[73] Assignee: Lucent Technologies, Inc., Murray Hill, N.J.

[21] Appl. No.: 13,395

[22] Filed: Jan. 26, 1998

[51] Int. Cl.[6] ..... H01R 43/09

[52] U.S. Cl. ..... 29/566.4; 29/758

[58] Field of Search ..... 29/566.4, 751, 29/758, 278, 566.1, 33.4; 7/107, 158; 173/120

[56] References Cited

U.S. PATENT DOCUMENTS

| | | | |
|---|---|---|---|
| 4,434,542 | 3/1984 | Forberg et al. | 29/566.4 |
| 4,696,090 | 9/1987 | Gregson et al. | 29/566.4 |
| 5,195,230 | 3/1993 | Krietzman | 29/751 X |
| 5,410,803 | 5/1995 | Gerhard, Jr. | 29/751 X |
| 5,813,109 | 9/1998 | Ziegler et al. | 29/566.4 |

*Primary Examiner*—William Briggs

[57] ABSTRACT

The present insulation displacement contact wire insertion tool that is used to enable a craftsperson to perform the various wire manipulation tasks required to insert and remove wires in insulation displacement contact connectors and terminal blocks. The wire insertion tool enables the craftsperson to place the wire in a stuffer blade that protrudes from the tip of the wire insertion tool while also threading the wire through a pair of wire cutting blades. The craftsperson can use the stuffer blade to press the wire into the insulation displacement contact and then operate the spring loaded cutting blades to cut the length of wire and receive an audible feedback that sufficient force has been applied to perform the operation. The single action of pressing the wire on to the insulation displacement contact both compresses the spring, installs the wire on the insulation displacement contact, and provides the audible feedback. The audible feed back is provided independently of whether the selector is set to cut the wire or to disable the wire cutter. The craftsperson can therefore perform the wire insertion and wire cutting functions with a single tool and with a single motion. The wire insertion tool also houses additional working blades for use by the craftsperson and can be set into a non-cutting mode where the tool installs the wire on the insertion displacement contact without cutting the wire.

5 Claims, 1 Drawing Sheet

INSULATION DISPLACEMENT CONTACT WIRE INSERTION TOOL

FIELD OF THE INVENTION

This invention relates to the communication systems physical plant environment and, in particular, to a wire insertion tool that is used to enable a craftsperson to perform the various wire manipulation tasks required to insert and remove wires in Insulation Displacement Contact (IDC) connectors and terminal blocks.

PROBLEM

It is a problem in the field of communication systems physical plant to provide the necessary tools to enable the craftsperson to perform their tasks in an efficient and reliable manner. A particular problem traditionally was the need for multiple tools to perform the various wire manipulation tasks that are required to insert and remove wires in insulation displacement contact connectors and terminal blocks. The need for numerous single function tools resulted in inefficient utilization of the craftsperson's time, since the craftsperson must execute the task in a multi-step process, each step of this process requiring the use of a different tool. An improvement in this field was the provision of a multi-function tool that significantly improves the efficiency of the craftsperson and automates the task of inserting and removing wires in insulation displacement contact connectors and terminal blocks to minimize the possibility of errors. However, the existing multifunction tools, such as that shown in U.S. Pat. No. 4,434,542, function to insert wires in the insulation displacement contact connectors but do not provide a tactile feed back mechanism that is operable regardless of whether the wire cutter blades are activated. Therefore, the installer has to estimate the correct force to apply if the wire is not to be cut by the multifunction tool. Too little force and the wire is not properly seated, too much force causes fatigue for the installer.

SOLUTION

The above described problems are solved and a technical advance achieved by the present insulation displacement contact wire insertion tool that is used to enable a craftsperson to perform the various wire manipulation tasks required to precisely insert and remove wires in insulation displacement contact connectors and terminal blocks, regardless of whether the wire is cut. The wire insertion tool enables the craftsperson to place the wire in a stuffer blade that protrudes from the tip of the wire insertion tool while also threading the wire through a pair of wire cutting blades. The craftsperson can use the stuffer blade to press the wire on to the insulation displacement contact, receiving tactile feedback to indicate that the proper force has been applied to insert the wire on the insulation displacement contact. The craftsperson can then operate the spring loaded cutting blades to cut the length of wire. The single action of pressing the wire on to the insulation displacement contact both compresses the spring and installs the wire on the insulation displacement contact. The craftsperson can therefore perform the wire insertion and wire cutting functions with a single tool and with a single motion. The wire insertion tool also houses additional working blades for use by the craftsperson and can be set into a non-cutting mode where the tool installs the wire on the insertion displacement contact without cutting the wire.

DETAILED DESCRIPTION

Figure 1:
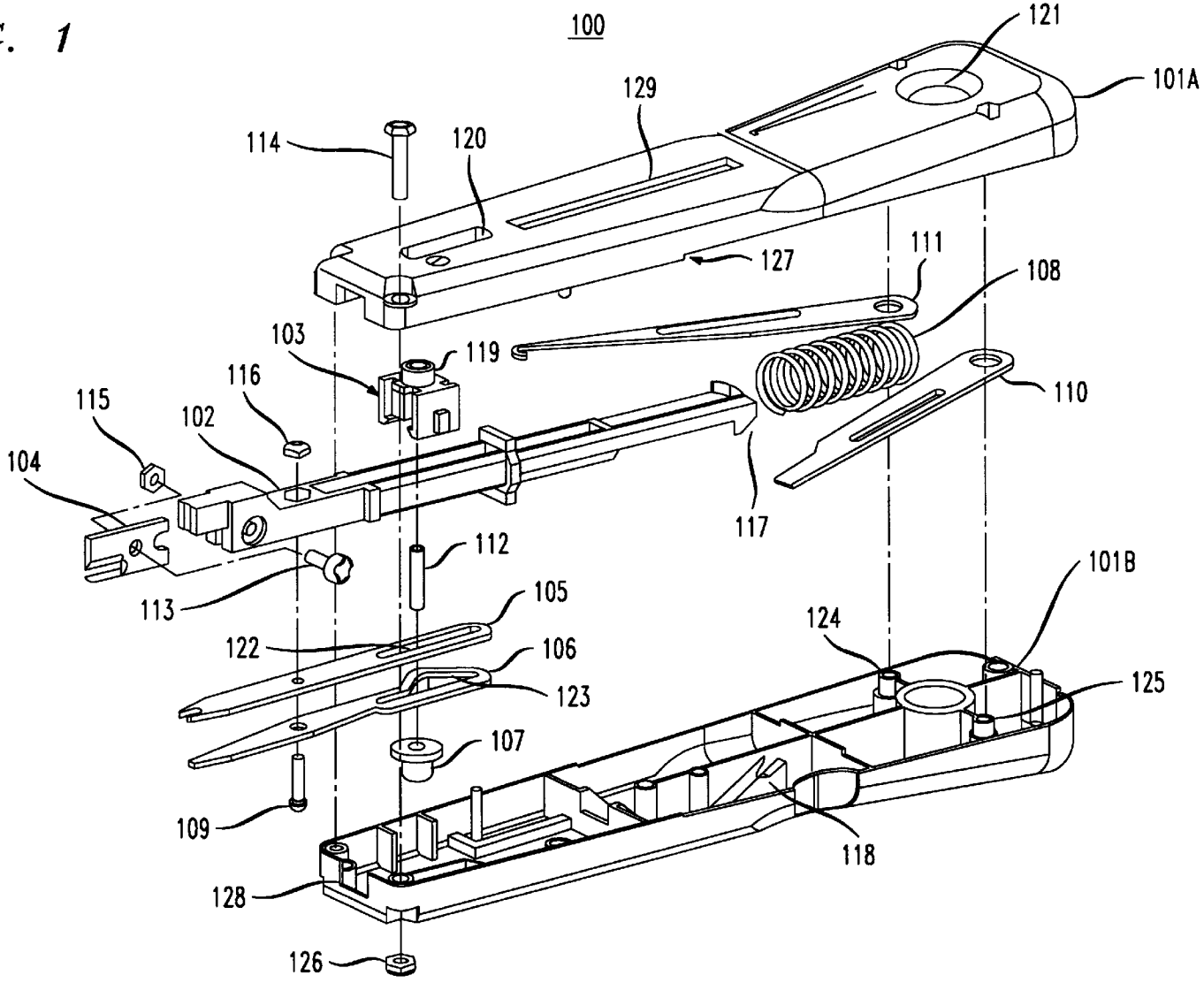
FIG. 1 illustrates an exploded perspective view of the present insulation displacement contact wire insertion tool.

FIG. 1 illustrates an exploded perspective view of the present insulation displacement contact wire insertion tool 100 that is used to enable a craftsperson to perform the various wire manipulation tasks required to insert and remove wires in insulation displacement contact connectors and terminal blocks. In the physical plant environment, punch-down wire, comprising individual wires inserted into individual Insulation Displacement Contact (IDC) slots, is used to make cross-connects in IDC connectors. In order to enable the craftsperson to perform this function, the present insulation displacement contact wire insertion tool 100 implements a plurality of tools within a single housing and operates to automate some of the required wire manipulation tasks. In particular, the wire insertion tool enables the craftsperson to place the wire in a stuffer blade 104 of stuffer bar 102 that protrudes from the tip of the wire insertion tool 100 through an aperture 128, while also optionally threading the wire through a pair of wire cutting blades 105, 106. The craftsperson can use the stuffer blade 104 to press the wire on to the insulation displacement contact and optionally use the spring loaded cutting blades 105, 106 to cut the length of wire. The single action of pressing the wire on to the insulation displacement contact both compresses the spring 108 and installs the wire on the insulation displacement contact. The craftsperson can therefore perform the wire insertion and wire cutting functions with a single tool and with a single motion. Ratchet elements 117, 118 are included in the tool to provide audible feedback to the craftsperson that the stuffer bar 102 has sufficient force applied to it to insert a wire into the insulation displacement slot of a connector and compress the spring 108 a predetermined amount.

The present insulation displacement contact wire insertion tool 100 comprises a handle that is composed to two mating handle halves 101A, 101B, formed as molded pieces and interconnected by a plurality of screw and nut fasteners, such as 114 and 126. The handle encloses a plurality of elements that are cooperatively operative to perform the various wire manipulation functions. A primary one of these enclosed elements is a stuffer bar 102 that functions to provide a platform to mount the stuffer blade 104, the upper and lower wire cutter blades 105, 106, the selector slide 103, and the compression spring 108. The stuffer bar 102 has two cantilever fingers 117 with ratchet features on the ends that mate with ratchet features 118 on the inside of each handle half 101A, 101B. The stuffer blade 104 is attached to the end of the stuffer bar 102 distal from the compression spring 108 by means of a screw-nut combination 113, 115. In operation, when a force is applied to the handle to insert a wire that is secured in stuffer blade 104 into an insulation displacement contact, the stuffer bar 102 moves backward into the handle 101, pushing against compression spring 108, moving the ratchet features of cantilever arms 117 up mating ramps 118 on the handle halves 101A, 101B until the ratchet features of cantilever arms 117 fall off of the end of ramps 118 and audibly snap back to the rest position. The ratchet elements 117, 118 thereby provide audible feedback to the craftsperson that the stuffer bar 102 has sufficient force applied to it to insert a wire into the insulation displacement slot of a connector and that stuffer bar 102 has been depressed a sufficient distance that cutter blades 105, 106 have traveled far enough to actuate the cam feature in slot 123 against dowel pin 112 to cause the cutter blade 106 to pivot and cut off the wire. The upper wire cutter blade 105 includes a notch formed in the distal end thereof to receive and hold the wire in position for cutting by the scissor type operation of the upper and lower wire cutter blades 105, 106. The upper and lower wire cutter blades 105, 106 are attached to the stuffer bar 102 by means of a shoulder screw 109 and nut 116.

The handle therefore holds the stuffer bar 102 in position and also provides stops to limit the stuffer bar 102 travel during wire insertion. In particular, the handle has slots 120 formed therein to limit the travel of the selector slide 103 and its integral button feature 119. Dowel pin 112 interconnects selector slide 103 and selector button 107 such that two buttons project out of the handle on opposite sides thereof (one the selector button 107, the other button 119 a part of the selector slide 103) and can be moved together to either the front or rear position for selecting the cutting mode. The selector slide 103 snaps onto the stuffer bar 102 and slides along it freely, thereby allowing the stuffer bar 102 to move in and out of the handle through aperture 128 without moving the selector slide 103. The selector slide 103 has two detents, one on either side, that mate with similar detents on each handle half 101A, 101B. The detents are designed to hold the selector slide 103 in either the forward no-cut or the rear cut position. The selector slide 103 also has a hole formed through the center thereof that is designed to hold one end of the dowel pin 112. The function of the selector slide 103 is to enable or disable the scissor action of the upper and lower wire cutter blades 105, 106 during wire insertion into an insulation displacement contact. When the selector slide 103 is positioned to the front of the handle 101 (toward the stuffer blade 104), the dowel pin 112 is positioned in the slot 123 of the lower cutter blade 106 beyond the cam feature that is formed in the slot 123. As a wire is inserted into the stuffer bar 104 and between the upper and lower wire cutter blades 105, 106 and the compression spring 108 is depressed, the upper and lower cutter blades 105, 106 move back in the handle 101 relative to the dowel pin 112. Because the dowel pin 112 starts out beyond the cam feature that is formed in the lower wire cutter blade 106, there is no camming action applied to the lower cutter blade 106 and the wire remains uncut. When the selector slide 103 is positioned to the rear of the handle, the dowel pin 112 is positioned before the cam feature that is formed in the lower wire cutter blade 106 so as the stuffer bar 102 is depressed into the handle 101 and the upper and lower wire cutter blades 105, 106 move relative to the dowel pin 112, the cam feature that is formed in the lower wire cutter blade 106 actuates the lower wire cutter blade 106 and the wire is cut by the scissor action of the upper and lower wire cutter blades 105, 106.

The compression spring 108 slides over the cantilever fingers 117 on the stuffer bar 102 and holds the stuffer bar 102 pretensioned in the extended position. As the tool inserts a wire and the force exerted against the handle 101 exceeds the initial pretension force exerted by the compression spring 108, the stuffer bar 102 is depressed into the handle 101. The stuffer bar 102 continues to depress into the handle 101 until it bottoms against bosses in the handle 101 between the cantilever fingers 117 on the stuffer bar 102.

There are a number of other implements and features that can be included in the present insulation displacement contact wire insertion tool 100. For example, spudger blade 110 is a multifunction blade for the convenience of the craftsperson. The spudger blade 110 pivots around feature 125 and plastic detents in the handle 101 hold the spudger blade 110 either in the fully closed position or the fully open position. The hook blade 111 is a general purpose blade that a craftsperson can use to remove wires from a connector module. The hook blade 111 pivots around feature 124 and plastic detents formed in the handle 101 also hold this blade in either the fully closed position of the fully open position. There is also a hole 121 in the handle near the back to allow it to hang on a distributing frame for ready access to a craftsperson.

What is claimed:

1. A wire insertion tool for the installation of a wire on to an insulation displacement contact comprising:

a handle;

a compression spring located in said handle;

stuffer bar, located in said handle and connected at a first end to said compression spring and movable through a predetermined range of motion from a first extent to a second extent, for compressing said compression spring when at a first extent of its range of motion;

stuffer blade affixed to an end of said stuffer bar distal from said first end for holding said wire for insertion on an insulation displacement contact;

first and second wire cutter blades connected to said stuffer bar and operable by a motion of said cutter bar moving from said first extent to said second extent for cutting said wire when said wire is held by said stuffer blade and inserted between said first and said second wire cutter blades; and means for providing tactile feedback to a user of said wire insertion tool when said compression spring has been compressed a predetermined amount, regardless of whether said first and said second wire cutter blades are operated to cut said wire.

2. The wire insertion tool of claim 1 further comprising:

means, having a first position and a second position, for enabling operation of said first and second wire cutter blades when in said first position and to disable operation of said first and second wire cutter blades when in said second position.

3. The wire insertion tool of claim 2, wherein said first wire cutter blade is stationary, further comprising:

means, responsive to said means for enabling being in said first position, for interconnecting a cam feature formed in said second wire cutter blade with said means for enabling to cause said second wire cutter blade to operate in opposition with said first wire cutter blade scissors fashion.

4. The wire insertion tool of claim 3 further comprising:

means, responsive to said means for enabling being in said second position, for interconnecting a slot formed in said second wire cutter blade with said means for enabling to cause said second wire cutter blade to fail to operate in opposition with said first wire cutter blade scissors fashion.

5. The wire insertion tool of claim 1 further comprising:

at least one additional tool element enclosed in said housing absent connection to said cutter bar.

* * * * *